US007607329B2

(12) United States Patent
Heller et al.

(10) Patent No.: US 7,607,329 B2
(45) Date of Patent: Oct. 27, 2009

(54) METHOD FOR FREE BENDING

(75) Inventors: Burkhard Heller, Leonding (AT); Michael Kaever, Erlangen (DE); Nader Ridane, Dortmund (DE)

(73) Assignee: Siemens Aktiengesellschaft, Munich (DE)

( * ) Notice: Subject to any disclaimer, the term of this patent is extended or adjusted under 35 U.S.C. 154(b) by 85 days.

(21) Appl. No.: 11/385,050

(22) Filed: Mar. 17, 2006

(65) Prior Publication Data

US 2006/0218984 A1 Oct. 5, 2006

(30) Foreign Application Priority Data

Mar. 17, 2005 (DE) ..... 10 2005 012 384

(51) Int. Cl.

| | |
|---|---|
| ***B21D 5/02*** | (2006.01) |
| ***B30B 15/26*** | (2006.01) |
| *B21C 51/00* | (2006.01) |
| *G06F 15/46* | (2006.01) |

(52) U.S. Cl. ..... 72/31.11; 72/389.3; 72/389.4; 72/702; 100/50; 100/257; 700/165; 700/206; 364/476.01; 364/474.07

(58) Field of Classification Search ..... 72/8.1, 72/19.1, 20.1, 21.1, 31.11, 31.12, 389.1, 72/389.3, 389.4, 389.5, 389.6, 702; 100/43, 100/46, 50, 257; 364/476, 474.07; 700/165, 700/206

See application file for complete search history.

(56) References Cited

U.S. PATENT DOCUMENTS 4,408,471 A * 10/1983 Gossard et al. ..... 700/206
4,511,976 A * 4/1985 Graf ..... 700/165
4,552,002 A 11/1985 Haenni et al.
4,819,467 A * 4/1989 Graf et al. ..... 72/20.1
4,962,654 A 10/1990 Zbornik
5,483,750 A * 1/1996 Ooenoki et al. ..... 72/389.3
6,192,732 B1 * 2/2001 Kojima ..... 72/20.1
6,581,427 B2 * 6/2003 Gerritsen ..... 72/31.11
6,871,521 B2 * 3/2005 Sperrer ..... 72/389.6
7,079,919 B2 * 7/2006 Gerritsen et al. ..... 700/165

FOREIGN PATENT DOCUMENTS

| | | |
|---|---|---|
| AT | 389 829 B | 2/1990 |
| EP | 0 096 278 B1 | 12/1983 |
| EP | 1 401 593 B1 | 3/2004 |

* cited by examiner

*Primary Examiner*—David B Jones

(57) ABSTRACT

With a method according to the invention for free bending, a workpiece to be machined, such as a sheet metal plate, is brought into contact with a bending edge of a lower die. A bending punching tool is moved opposite to the lower die, such that the sheet metal plate is bent by the punching tool in terms of generating a predetermined target bending angle across the bending edge. In this case, the achieved bending angle is measured at least after a first bending process and the bending force to be applied and the measuring curve resulting therefrom are determined during the bending process as a function of the traverse path of the bending punching tool. A correction value for the course of the bending process is subsequently determined from the resulting deviation between the predetermined target bending angle and the achieved bending angle and as a result of the detected measurement curve and a model-based calculation of the bending behavior and further bending processes are carried out in view of the correction values.

12 Claims, 2 Drawing Sheets

METHOD FOR FREE BENDING

CROSS REFERENCE TO RELATED APPLICATIONS

This application claims priority to the German Application No. 10 2005 012 384.8, filed Mar. 17, 2005 which is incorporated by reference herein in its entirety.

FIELD OF INVENTION

The present invention relates to a method for free bending.

BACKGROUND OF INVENTION

Free bending is the machining of a workpiece, whereby a workpiece to be machined, such as a sheet metal plate, is brought into contact with a bending edge of a lower die. The movement of a punching tool towards the lower die allows the sheet metal plate to be bent along the bending edge, with a target bending angle being generated in the sheet metal piece by means of controlling or regulating the traverse path of the punching tool.

SUMMARY OF INVENTION

The monitoring and the determination of the generation of the target bending angle can either be carried out in this case by a corresponding manual iterative adjustment of the bending machine by means of measuring the achieved bending angle subsequent to a bending process or by means of monitoring the achieved bending angle during a bending process and by controlling the bending process including subsequent bending processes during the bending.

The first procedure is advantageous in that the bending can be carried out in a rapidly operating bending process, thereby enabling a high production speed to be achieved. However, the adjustment process is complex and must be carried separately for each batch of material. The second procedure requires an ongoing measurement of the bending angle during the bending, whereby the bending itself can only be carried out at a lower speed. This procedure is thus not suited to large series production.

In contrast, an object of the invention is to carry out bending processes with a low deviation from the target bending angle, which is suited to large series production due to the operating speed.

This object is achieved by the claims.

In a method for free bending a workpiece to be machined, such as a sheet metal plate, is brought into contact with a bending edge of a lower die. A bending punching tool is moved to the lower die such that the sheet metal plate is bent by the punching toot in terms of generating a predetermined target bending angle across the bending edge. In this case, the achieved bending angle is measured at least after a first bending process and the bending force to be applied and the measuring curve resulting therefrom are determined during the bending process as a function of the path traversed by the bending punching tool. A correction value is subsequently determined for the course of the bending process from the resulting deviation between the predetermined target bending angle and the achieved bending angle. The correction value is based on the detected measuring curve as well as a model-based calculation of the bending behavior. Further bending processes are carried out in view of the correction values.

These measures allow the deviation from the target bending angle to be set in relation to the measuring curve and to deduce therefrom the required changes in the bending process. Adjustment to the bending process can be calculated according to the bending behavior. The number of required bending processes carried out to achieve a high bending precision is reduced. The adjustment not only relies on the experience of the machine operator but can also be repeated. The speed of adjusting the settings is thereby increased. Individual monitoring of the bending angle is not needed during subsequent bending processes, thereby readily allowing for a rapid implementation of the bending angle.

In this case, the model forming the basis of the bending process advantageously not only comprises the calculation of the bending behavior of the workpiece but also a model of the machine on which the bending process is carried out. Influences on the machine, such as the expansion and shear force components can be taken into account in the material and dynamic behavior of the bending edge.

Provision can be made for the first bending process to be carried out on the basis of a model-based calculation of the bending process. This is advantageous in that the achieved bending angle of the first bending process lies as close as possible to the target bending angle to be achieved.

According to an advantageous embodiment of the invention, the bending process is carded out by controlling or regulating the path traversed by the punching tool according to at least one of the variables from the traversed path, required punching tool force or a combination thereof. Provision can also be made for a bending process to feature a subsequent bending step. A bending process is carried out with a subsequent bending step. After a specific backward movement of the punching tool, in which a resilient force of the bending point can take place, a second bending is carried out. This enables the target bending angle to be achieved with materials of high elasticity.

In an advantageous embodiment of the invention, the model-based determination of the correction value includes a simulation of the bending process based on an iterative calculation according to a finite element method. The use of a finite element method allows the nonlinear bending process to be calculated with a high degree of accuracy. This may result in calculation of an iterative series of small bending angles to provide a linear bending processes. A simple computer may perform calculations to model the bending process, providing the bending force to be achieved and/or the path to be traversed by the punching tool.

According to an advantageous embodiment, the correction value is determined using databases for at least one actuating variable influencing the bending behavior. The gathering of actuating variables and allocated required correction values allows an experience-based rapid determination of the correction values. Intermediate values can also be approximated by suitable interpolation or extrapolation from known values of the databases. According to an advantageous embodiment of the invention in particular, at least one of the variables from shear force influence, machine model, disturbance variable and resilience can be used as the actuating variable. Fluctuations in the material composition and the material strength of the workpiece to be bent are regarded as disturbance variables. In this case, from the deviation and the measuring curve, conclusions can be drawn on the actuating variables and relative weighting. In this regard, it is particularly characterized as to how, on the basis of an actuating variable, the measuring curve is influenced in its behavior across the traverse path. Conclusions can be drawn on the weighting of the different actuating variables from a corresponding comparison with the measured measuring curve.

It corresponds in this case to an advantageous embodiment, if the cutting and bending sequence of the workpiece is carried out as a function of the model-based determined bending behavior in the bending machine.

A bending machine according to the invention for implementing a bending method here comprises a control device, which detects the traverse movement of a bending punching tool compared with the bending edge of the lower die. A measuring device is thus issued, which detects the path of the punching tool and the force applied in this path, said force being required in order to achieve the traverse path.

BRIEF DESCRIPTION OF THE DRAWINGS

The invention is also described in more detail below with reference to the exemplary embodiment illustrated in the drawings, wherein.

DETAILED DESCRIPTION OF INVENTION

Figure 1:
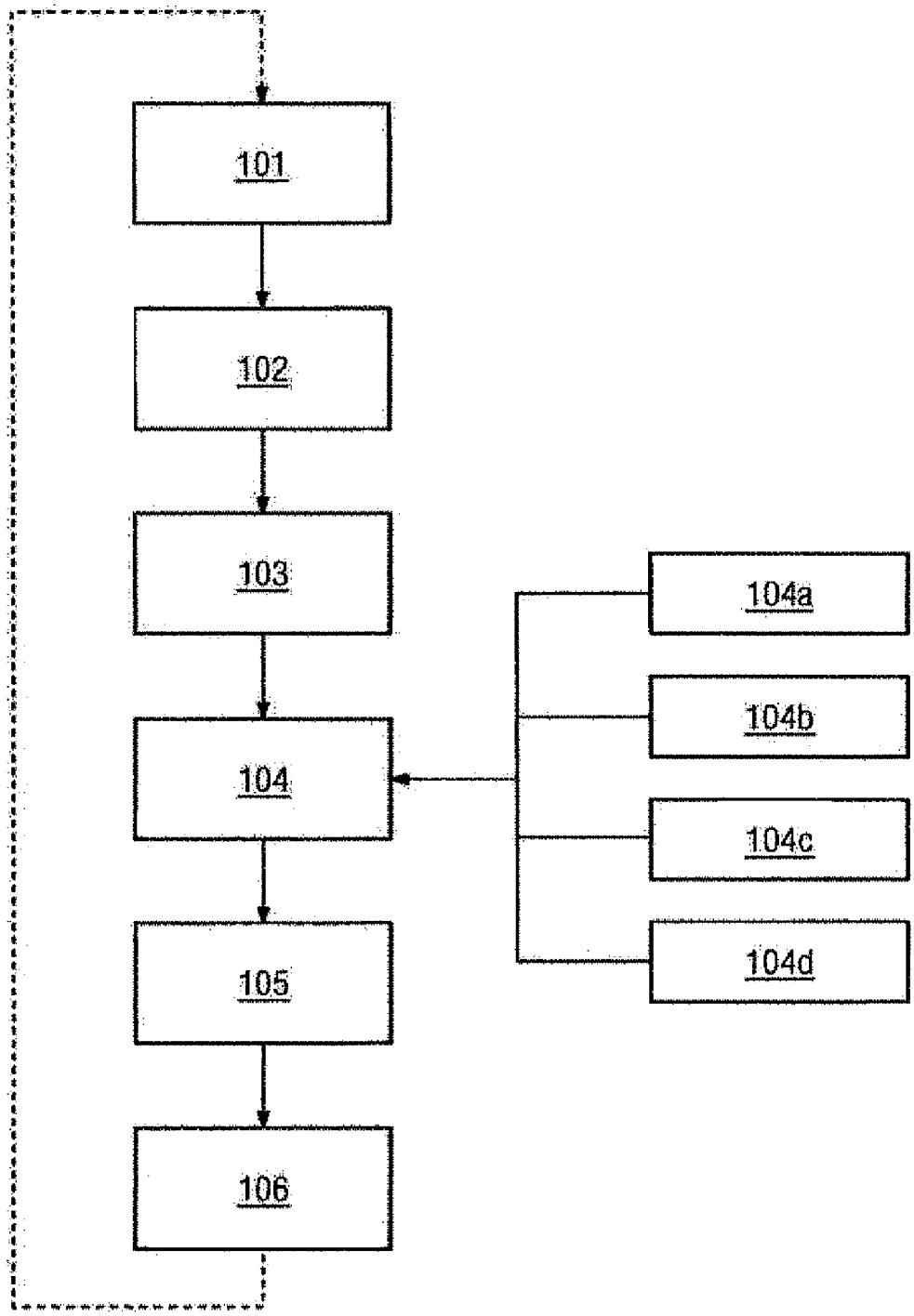
FIG. 1 shows a flow diagram of a method according to the invention and FIG. 2 is a simplified schematic illustration, not to scale, of components in a bending punching tool operating on a workpiece.
Figure 2:
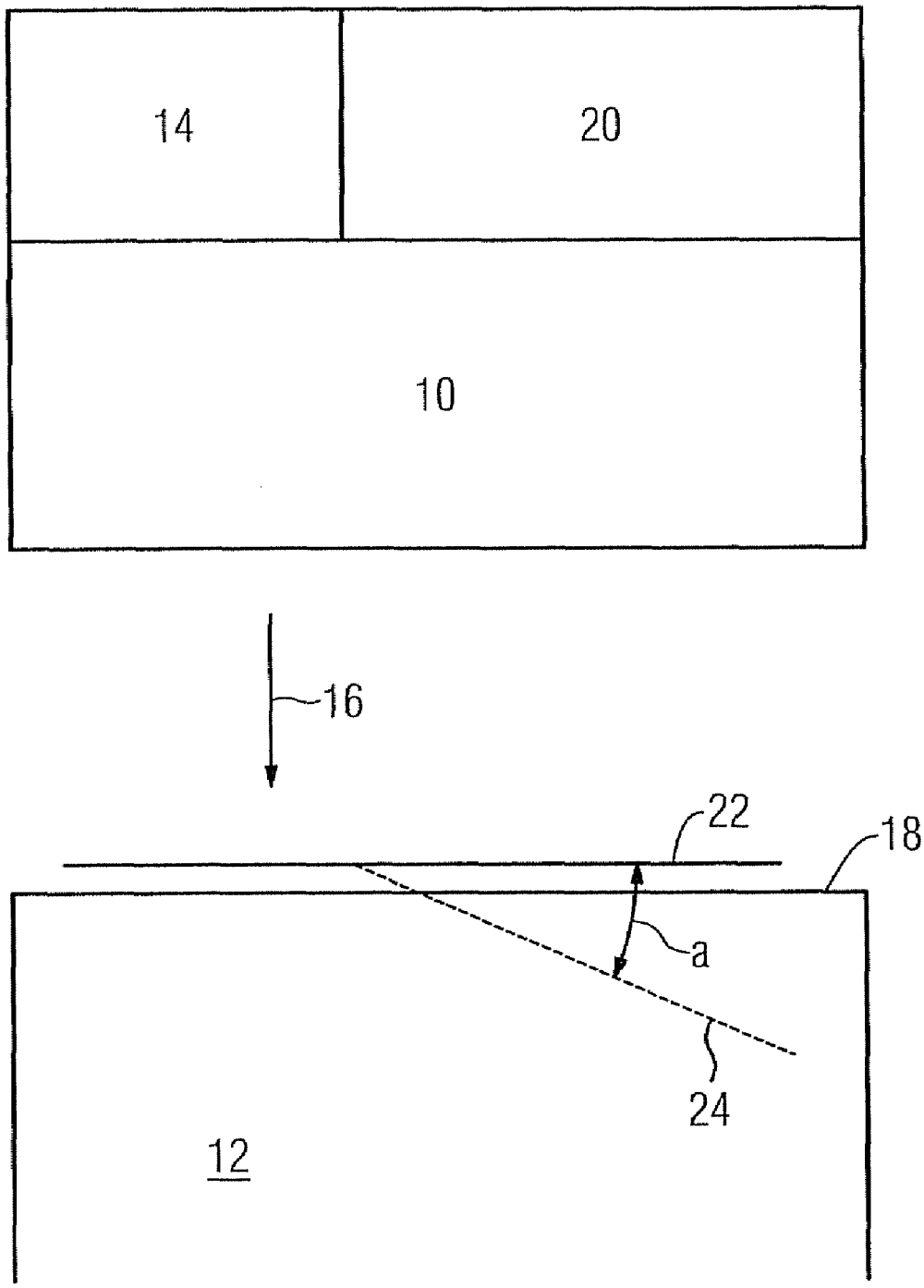

According to step 101 of the method (see FIG. 1), a calculation is made as to how a bending punching tool 10, shown in FIG. 2, of a free bending machine is to be moved on the basis of the construction data of the workpiece to be generated, on the basis of a model of the workpiece to be machined and of the required bending process. In this example, the free bending machine comprises the bending punching tool 10 and a lower die 12. A control device 14 detects the traverse movement 16 of the bending punching tool 10 compared with the bending edge 18 of the tower die 12. A measuring device 20 detects the path of the punching tool 10 and the force applied in this path, said force being required in order to achieve the traverse path.

A bending process is performed on an initial sheet metal workpiece configuration 22 in accordance with step 102 on the basis of the calculated bending process. The achieved bending angle a is shown for a bent workpiece configuration 24 with respect to the original workpiece configuration 22. For clarity the bent configuration 24 is illustrated in phantom lines. According to step 103, the achieved bending angle a is compared with the target bending angle to be achieved. The correction values are determined in step 104 on the basis of the comparison. In this case, correction values are applied in step 104 from databases 104*a*, 104*b*, 104*c*, 104*d*, said correction values being allocated the individual actuating variables such as shear force, machine model, disturbance variables and resilience.

In step 105, the correction values are then applied to the used control data. Correspondingly, the control data are then determined for subsequent bending processes in step 106.

The data of the correction values can in turn be taken into consideration with the construction, the dimensioning and the cutting of corresponding elements to be bent. New values can also be generated for the databases 104*a* to 104*d* by means of a precise analysis of the bending result of the implemented bending process, so that the stored data of these databases continuously increases.

The method can be carried out repeatedly iteratively so as to achieve an even higher manufacturing precision. On the other hand, correction values achieved even after the first bending process and the control data of the bending process resulting therefrom according to step 106 can be used for the series production of the bending element.

The bending process can also be easily separately adjusted for each batch of workpieces so as to allow for different material characteristics.

The invention claimed is:

1. A free bending process, comprising:

prescribing a bending angle about which a workpiece is to be bent;

bringing the workpiece into contact with a bending edge of a lower die about which the bending angle is to be formed, the workpiece arranged as a sheet metal plate relative to the lower die;

executing a first bending process step including bending the sheet metal plate across the bending edge by moving a bending punching tool relative to the lower die for generating a current bending angle of the sheet metal plate;

measuring the generated current bending angle at least after executing the first bending process step;

executing further bending process steps each corresponding to the first bending process step;

determining during the further bending process steps a plurality of bending forces to be applied by the bending punching tool for achieving the prescribed bending angle relative to a trajectory of the bending punching tool;

creating a measuring curve including the determined bending forces related to the trajectory;

determining an angle deviation from the current bending angle and the prescribed bending angle;

calculating a correcting parameter based on the determined angle deviation, the created measuring curve and a model calculation representing the free bending process; and executing at least one final bending process step corresponding to the first bending process step based upon the calculated correcting parameter.

2. The process according to claim 1, wherein the first, further and final bending process steps include controlling the trajectory of the bending punching tool based on a current trajectory of the bending punching tool and/or a current bending force to be applied by the bending punching tool.

3. The process according to claim 2, wherein controlling the trajectory is influenced by the correcting parameter, the correcting parameter adjusting the current trajectory and/or the current bending force.

4. The process according to claim 1, wherein the first bending process step includes a subsequent correction bending step.

5. The process according to claim 2, wherein the model calculation includes a simulation of the free bending process based upon an iterative calculation according to a finite element method.

6. The process according to claim 1, wherein the correcting parameter includes at least one bending parameter having an influence on bending characteristics of the workpiece, the at least one bending parameter included in and acquired from a material property database.

7. The process according to claim 6, wherein the bending parameter is selected from the group consisting of a shear force influence, a model of a machine used for executing the free bending process, disturbance parameters influencing the free bending process and a spring back force of the workpiece.

8. The process according to claim 6, wherein a value of the bending parameter is determined from the determined angle deviation and the measuring curve.

9. The process according to claim 6, wherein at least two bending parameters and a relative weighting of the identified bending parameters are determined using the determined angle deviation, the measuring curve and the model calculation.

10. A method according to claim 1, wherein cutting steps and a sequence of bending process steps are determined and executed during the free bending process for achieving the prescribed bending angle.

11. A bending machine for free bending of a workpiece at a prescribed bending angle, comprising:

a control device for controlling a trajectory of a bending punching tool relative to a bending edge of a lower die, and a measuring device for:

(i) determining a trajectory of the bending punching tool and for determining a plurality of forces applied to the workpiece by the bending punching tool during the trajectory such that the plurality of forces are used to form a measuring curve relative to the trajectory; and (ii). calculating a correcting parameter, relative to the prescribed bending angle and a determined angle deviation therefrom, the created measuring curve and a model calculation representing the free bending process, with which bending forces for achieving the prescribed bending angle are determined, wherein:

the model calculation includes a simulation of the free bending process based upon an iterative calculation according to a finite element method.

12. A free bending process, comprising:

prescribing a bending angle about which a workpiece is to be bent;

bringing the workpiece into contact with a bending edge of a lower die about which the bending angle is to be formed, the workpiece arranged as a sheet metal plate relative to the lower die;

executing a first bending process step including bending the sheet metal plate across the bending edge by moving a bending punching tool relative to the lower die for generating a current bending angle of the sheet metal plate;

measuring the generated current bending angle at least after executing the first bending process step;

executing further bending process steps each corresponding to the first bending process step;

determining during the further bending process steps a plurality of bending forces to be applied by the bending punching tool for achieving the prescribed bending angle relative to a trajectory of the bending punching tool;

creating a measuring curve including the determined bending forces related to the trajectory;

determining an angle deviation from the current bending angle and the prescribed bending angle;

calculating a correcting parameter based on the determined angle deviation, the created measuring curve and a model calculation representing the free bending process, wherein the correcting parameter includes at least one bending parameter having an influence on bending characteristics of the workpiece, the at least one bending parameter included in and acquired from a material property database, wherein new values for the database are generated based upon a precise analysis of the bending result of the implemented bending process, such that the stored data of the database continuously increases; and executing at least one final bending process step corresponding to the first bending process step based upon the calculated correcting parameter.

* * * * *